US008058540B2

(12) United States Patent
Furuta et al.

(10) Patent No.: US 8,058,540 B2
(45) Date of Patent: Nov. 15, 2011

(54) STRAP FOR MUSICAL INSTRUMENT AND METHOD FOR ADJUSTING LENGTH OF STRAP BELT

(75) Inventors: Hajime Furuta, Nagoya (JP); Yuko Naganawa, Nagoya (JP)

(73) Assignee: Hoshino Gakki Co., Ltd. (JP)

( * ) Notice: Subject to any disclaimer, the term of this patent is extended or adjusted under 35 U.S.C. 154(b) by 1 day.

(21) Appl. No.: 12/336,651

(22) Filed: Dec. 17, 2008

(65) Prior Publication Data

US 2010/0077902 A1 Apr. 1, 2010

(30) Foreign Application Priority Data

Sep. 29, 2008 (JP) ..... 2008-250934

(51) Int. Cl.
*G10D 3/00* (2006.01)

(52) U.S. Cl. ..... 84/327

(58) Field of Classification Search ..... 84/327, 84/329, 421

See application file for complete search history.

(56) References Cited

U.S. PATENT DOCUMENTS 6,269,991 B1 * 8/2001 Hood et al. ..... 224/258
7,582,819 B1 * 9/2009 Beddow et al. ..... 84/327

FOREIGN PATENT DOCUMENTS

| | | |
|---|---|---|
| JP | 50-31922 | 4/1975 |
| JP | 53-150142 | 11/1978 |
| JP | 1-172099 | 12/1989 |
| JP | 6-286511 | 10/1994 |
| JP | 6-77516 | 11/1994 |
| JP | 2001-46137 | 2/2001 |
| JP | 2001-083962 | 3/2001 |
| JP | 2001-197917 | 7/2001 |
| JP | 2005-58250 | 3/2005 |
| JP | 2006-263427 | 10/2006 |
| WO | WO 2008/012870 A1 | 1/2008 |

OTHER PUBLICATIONS

Official Action issued in counterpart Japanese Application No. 2008-250934 dated Sep. 21, 2010 with English translation.

Japanese Decision to Grant a Patent dated Jun. 14, 2011 in corresponding Japanese Patent Application No. 2008-250934 (Japanese language).

English translation of the Japanese Decision to Grant a Patent dated Jun. 14, 2011 in corresponding Japanese Patent Application No. 2008-250934.

* cited by examiner

*Primary Examiner* — Kimberly R Lockett
(74) *Attorney, Agent, or Firm* — Ostrolenk Faber LLP

(57) ABSTRACT

A guitar strap 10 includes an adjuster 13 by which the length of a second belt section 17 is adjusted. The adjuster 13 includes a base 31, a lever 32 manipulated to adjust the length of the second belt section 17, and a torsion spring 38 urging the lever 32 to pivot in a first direction. The second belt section 17 is clamped by the base 31 and the lever 32 due to urging force of the torsion spring 38. The second belt section 17 is released from a state clamped by the base 31 and the lever 32 by pivoting the lever 32 in a second direction, which is different from the first direction, against the urging force of the torsion spring 38.

10 Claims, 6 Drawing Sheets

STRAP FOR MUSICAL INSTRUMENT AND METHOD FOR ADJUSTING LENGTH OF STRAP BELT

BACKGROUND OF THE INVENTION

The present invention relates to a strap for a musical instrument and a method for adjusting the length of a strap belt.

Using the strap for the musical instrument, the musical instrument, such as a key board or a guitar, is hung down from the shoulders of a player when the musical instrument is played. For example, as disclosed in Japanese Laid-Open Patent Publication No. 2001-83962, a guitar strap (hereinafter, referred to as a "strap") includes a strap belt formed of nylon or leather, an adjuster to adjust the length of the strap belt, and a pair of strap connectors. The strap connectors are arranged at both ends of the strap belt and selectively attached to and detached from the body of a guitar.

Before hanging the guitar down from the shoulders, the player adjusts the length of the strap belt using the adjuster. The player then checks whether the length of the strap belt is appropriate. In many cases, the player continues to fine adjust the length of the strap belt until the guitar is located at the most comfortable position for the player to play. In other words, the adjustment of the length of the strap belt is one of the delicate steps carried out by the player.

However, conventional straps do not allow the player to adjust the length of the strap belt with the guitar hung down from the shoulders of the player. As a result, each time the length of the strap belt is to be adjusted, the player must put down the guitar repeatedly and then put it back around the shoulders to see whether the adjustment is appropriate. Such continuous adjustment is extremely inefficient and troublesome for the player.

SUMMARY OF THE INVENTION

Accordingly, it is an objective of the present invention to provide a strap for a musical instrument and a method for adjusting the length of a strap belt that allow the player to adjust the length of the strap belt with a guitar hung down from the shoulders of the player.

To achieve the foregoing objective and in accordance with a first aspect of the present invention, a strap for a musical instrument including a strap belt and an adjuster that adjusts the length of the strap belt is provided. The adjuster includes a base, a lever pivotally secured to the base and manipulated to adjust the length of the strap belt, and urging means arranged between the base and the lever and urging the lever to pivot in a first direction. The strap belt is clamped by the base and the lever due to an urging force of the urging means and released from a state clamped by the base and the lever by pivoting the lever in a second direction different from the first direction against the urging force of the urging means.

In accordance with a second aspect of the present invention, a method for adjusting the length of a strap belt using a strap for the musical instrument is provided. The strap includes a strap belt and an adjuster that adjusts the length of the strap belt. The adjuster includes a base, a lever pivotally secured to the base and manipulated to adjust the length of the strap belt, and urging means arranged between the base and the lever and urging the lever to pivot in a first direction. The strap belt is clamped by the base and the lever due to an urging force of the urging means and released from a state clamped by the base and the lever by pivoting the lever in a second direction different from the first direction against the urging force of the urging means. A body of the musical instrument has a pair of ends to which both ends of the strap belt are attached. The adjuster is arranged in the vicinity of either one of the ends of the body. The strap belt is configured by a first belt section attached to a first end of the body and a second belt section attached to a second end of the body. The adjuster is secured to the first or second belt section and adjusts the length of the belt section to which the adjuster is secured. The adjuster is one of a first adjuster and a second adjuster. The first adjuster is arranged in the first belt section to adjust the length of the first belt section, and the second adjuster is arranged in the second belt section to adjust the length of the second belt section. The method includes: adjusting the length of the strap belt by adjusting the length of the first belt section using the first adjuster before the musical instrument is hung down from the shoulders of a player; and fine adjusting the length of the strap belt by adjusting the length of the second belt section using the second adjuster with the musical instrument hanging down from the shoulders of the player after the length of the first belt section has been adjusted.

DETAILED DESCRIPTION OF THE PREFERRED EMBODIMENTS

One embodiment of a strap for a musical instrument according to the present invention, or a guitar strap, will now be described with reference to FIGS. 1 to 7.

Figure 1:
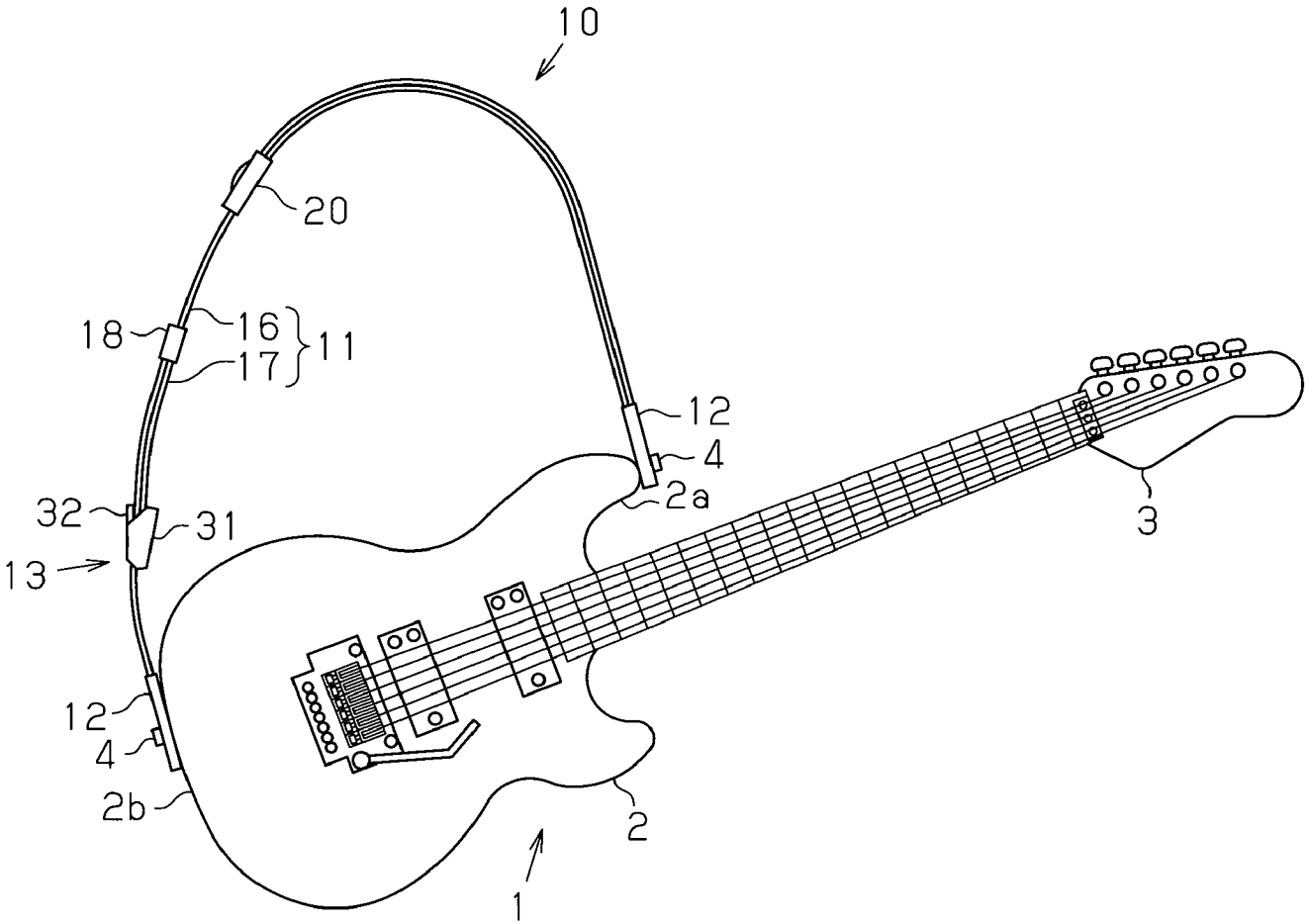
FIG. 1 is a front view showing a guitar strap according to one embodiment of the present invention attached to a guitar.
Figure 2:
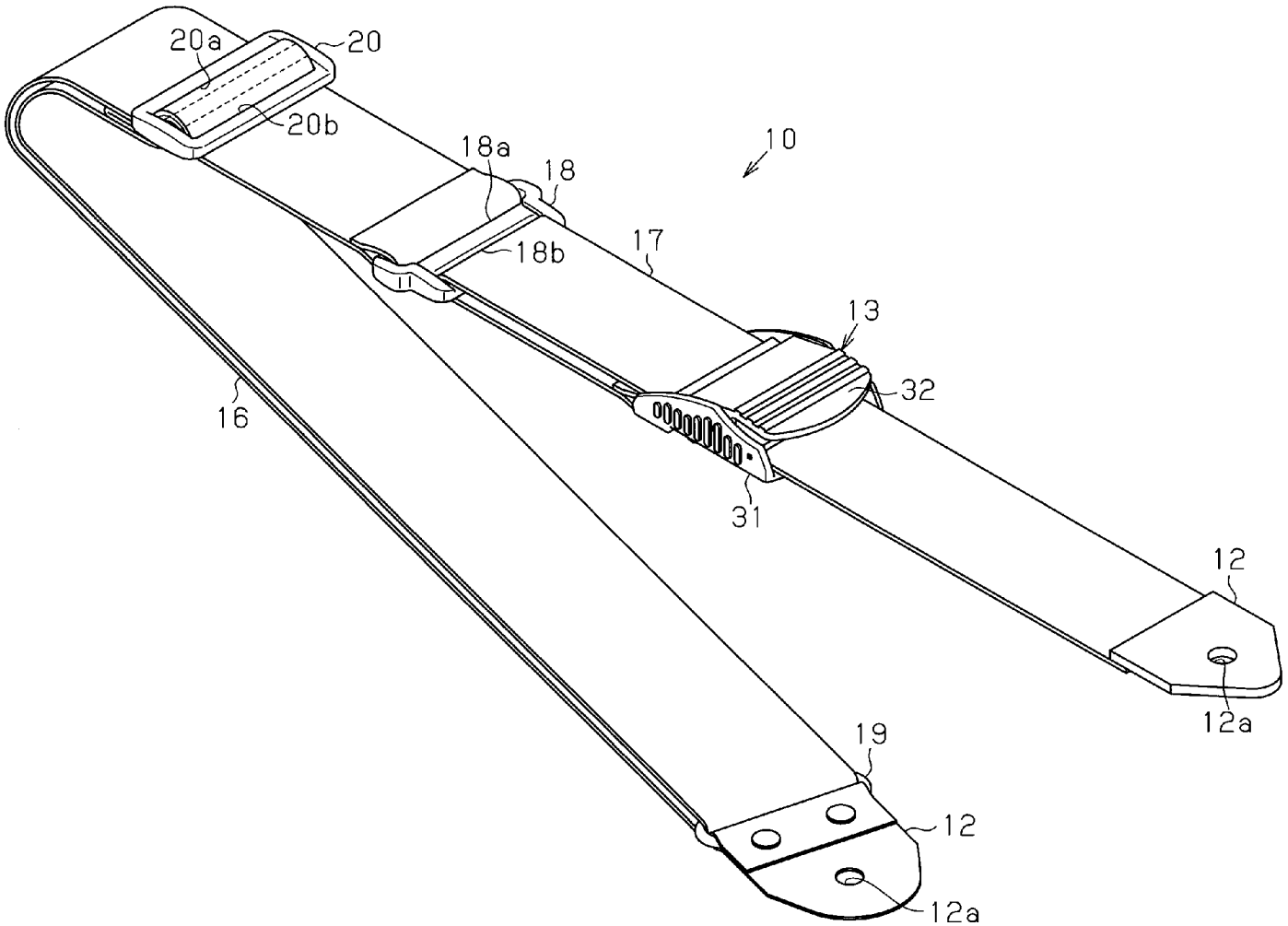
FIG. 2 is a perspective view showing the guitar strap.

As shown in FIGS. 1 and 2, a guitar strap (hereinafter, referred to as a "strap") 10 includes a strap belt 11 and a pair of strap connectors (hereinafter referred to as "connectors") 12, which are arranged at both ends of the strap belt 11. A body 2 of a guitar 1 has a connector pin 4 located at a first end 2*a* closer to a head 3 and a connector pin 4 arranged at a second end 2*b* opposite to the first end 2*a*. In the strap 10, an insertion hole 12*a* is formed at the center of each one of the connectors 12. The connector pins 4 of the guitar 1 are thus passed through the corresponding insertion holes 12*a*. The strap 10 is attached to both ends of the body 2 of the guitar 1 through the connectors 12 and the connector pins 4.

The strap belt 11 has two independent first and second belt sections 16, 17 and a joint member 18, which joins the first and second belt sections 16, 17 to each other. The first and second belt sections 16, 17 are each formed of resin such as nylon or polypropylene, fibers such as fabric, or leather. The joint member 18 is formed of a highly rigid material, which is, for example, resin such as polycarbonate or metal. Two slits 18*a*, 18*b* having different lengths are formed in the joint member 18. An end of the first belt section 16 is engaged with the longer one of the slits 18*a*, 18*b*, which is a slit 18*a*. The second belt section 17 is engaged with the shorter one of the slits 18*a*, 18*b*, which is a slit 18*b*.

An adjuster 20 serving as a first adjuster and a ring 19 are secured to the first belt section 16. The adjuster 20 adjusts the length of the first belt section 16. The ring 19 connects the first belt section 16 to the corresponding one of the connectors 12. The adjuster 20 is formed of highly rigid material, which is, for example resin such as polycarbonate or metal. The adjuster 20 is formed substantially in a rectangular shape. Two slits 20*a*, 20*b* are formed in the adjuster 20 and extend in the longitudinal direction of the adjuster 20.

The first belt section 16 is passed through the slits 20*a*, 20*b* of the adjuster 20 and the ring 19 and is thus supported slidably with respect to the slits 20*a*, 20*b* and the ring 19. One of the ends of the first belt section 16 is passed through the slit 18*a* of the joint member 18 and sewn to a different portion of the first belt section 16. The other end of the first belt section 16 is wound around the portion between the slits 20*a*, 20*b* of the adjuster 20 and is sewn to another portion of the first belt section 16. In this manner, with the ends of the first belt section 16 connected to the joint member 18 and the adjuster 20, the first belt section 16 is assembled with the adjuster 20 and the ring 19 in a slidable manner. The portion of the first belt section 16 between the adjuster 20 and the ring 19 is formed in a looped shape, or in such a manner that a portion of the first belt section 16 is overlapped with another portion of the first belt section 16.

By sliding the adjuster 20 along the first belt section 16, the length of the overlapped portion of the first belt section 16 is changed. This changes the length of the first belt section 16, thus altering the length of the strap belt 11. Specifically, as the adjuster 20 is slid toward the ring 19, the overlapped portion of the first belt section 16 becomes shorter, and the first belt section 16 becomes longer correspondingly. In contrast, as the adjuster 20 is slid toward the joint member 18, the overlapped portion of the first belt section 16 becomes longer, and the first belt section 16 becomes shorter correspondingly. Through such sliding of the adjuster 20, the first belt section 16 can be extended to a length substantially equal to the full length of the first belt section 16 or shortened to a length that is substantially half the length of the first belt section 16.

An adjuster 13 serving as a second adjuster is secured to the second belt section 17 to adjust the length of the second belt section 17. The adjuster 13 is arranged in the vicinity of the second end 2*b* of the body 2 of the guitar 1. As shown in FIGS. 3 to 6, the adjuster 13 includes a base 31, a lever 32, and a torsion spring 38 serving as urging means. The base 31 has a rectangular bottom wall 31*a* and a pair of side walls 31*b*, which extend from opposite sides of the bottom wall 31*a* and each have a substantially triangular shape. Two elongated holes 31*c*, 31*d*, each of which extends along the direction of the width of the base 31, are formed in the bottom wall 31*a* of the base 31. The width of the elongated hole 31*c*, which is closer to an end of the bottom wall 31*a*, is smaller than the width of the elongated hole 31*d*, which is arranged at the center of the bottom wall 31*a*. An impact absorbing member 33 formed by a rectangular rubber plate is located on an outer surface of the bottom wall 31*a* of the base 31. The impact absorbing member 33 absorbs an impact caused by contact between the adjuster 13 and the body 2 of the guitar 1.

The lever 32 includes a cover portion 34 and a stopper portion 35. The cover portion 34 covers the inner surface of the base 31. The stopper portion 35 presses the second belt section 17 against the bottom wall 31*a* of the base 31. The cover portion 34 has a securing portion 34*a* secured to the base 31 and a manipulating portion 34*b*, which is manipulated to adjust the length of the second belt section 17. A pair of side walls 34*c*, which extend toward the bottom wall 31*a* of the base 31 and each have a substantially triangular shape, are formed at opposite side ends of the securing portion 34*a*. The lever 32 is arranged in such a manner that the outer surfaces of the side walls 34*c* of the securing portion 34*a* face the inner surfaces of the side walls 31*b* of the base 31. The lever 32 is pivotally secured to the side walls 31*b* of the base 31 through a shaft 36 extending through the side walls 34*c* of the securing portion 34*a*. A plurality of serrations 34*d* project from the manipulating portion 34*b* and extend along the direction of the width of the lever 32. The serrations 34*d* facilitate manipulation of the lever 32 by preventing slipping of the hand.

The stopper portion 35 extends from the distal end of the cover portion 34 toward the bottom wall 31*a* of the base 31. The distal end of the stopper portion 35 is arranged at the position corresponding to the elongated hole 31*d*, which is located at the center of the base 31. A projected portion 35*a* is formed at the center of the stopper portion 35 and projects along the bottom wall 31*a* of the base 31. The projected portion 35*a* extends in the direction of the width of the lever 32 and covers the entire width of the lever 32. Slip preventing means is provided in the projected portion 35*a* to prevent slipping of the lever 32 and the second belt section 17 with respect to each other. The slip preventing means is formed by a plurality of projections 37 projecting from the backside of the projected portion 35*a* facing the bottom wall 31*a* of the base 31. Each projection 37 is tapered toward the distal end. The projections 37 extend over the entire portion of the backside of the projected portion 35*a*.

The torsion spring 38 is arranged between the base 31 and the lever 32. The torsion spring 38 includes a coil portion 38*a* and a pair of arm portions 38*b* extending from both ends of the coil portion 38*a*. The shaft 36 extends through the center of the coil portion 38*a* of the torsion spring 38. The two arm portions 38*b* support the shaft 36 between the base 31 and the lever 32. One of the arm portions 38*b* of the torsion spring 38 is supported by a support bar 39 extending between both side walls 31*b* of the base 31. The other arm portion 38*b* of the torsion spring 38 is engaged with an engagement recess 40 formed in the corresponding inner surface of the lever 32. Specifically, the engagement recess 40 is defined between two projections 41 projecting from the inner surface of the lever 32.

The torsion spring 38 is supported in a state storing a predetermined amount of urging force by the shaft 36, the support bar 39, and the inner surface of the lever 32. In this state, the lever 32 is constantly urged by the urging force of the torsion spring 38 to pivot in a first direction (the direction indicated by the arrow in FIG. 5) with respect to the base 31. The term "first direction" herein refers to a direction in which the stopper portion 35 of the lever 32 is pressed against the bottom wall 31*a* of the base 31.

Figure 3:
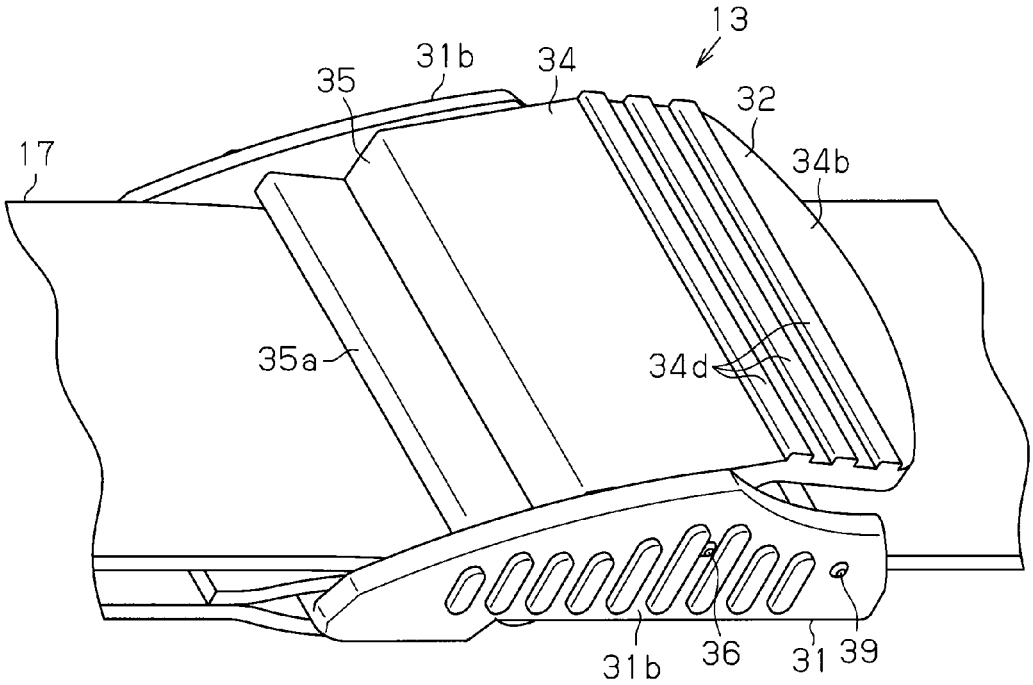
FIG. 3 is an enlarged perspective view showing the vicinity of an adjuster of the guitar strap as viewed from front.
Figure 4:
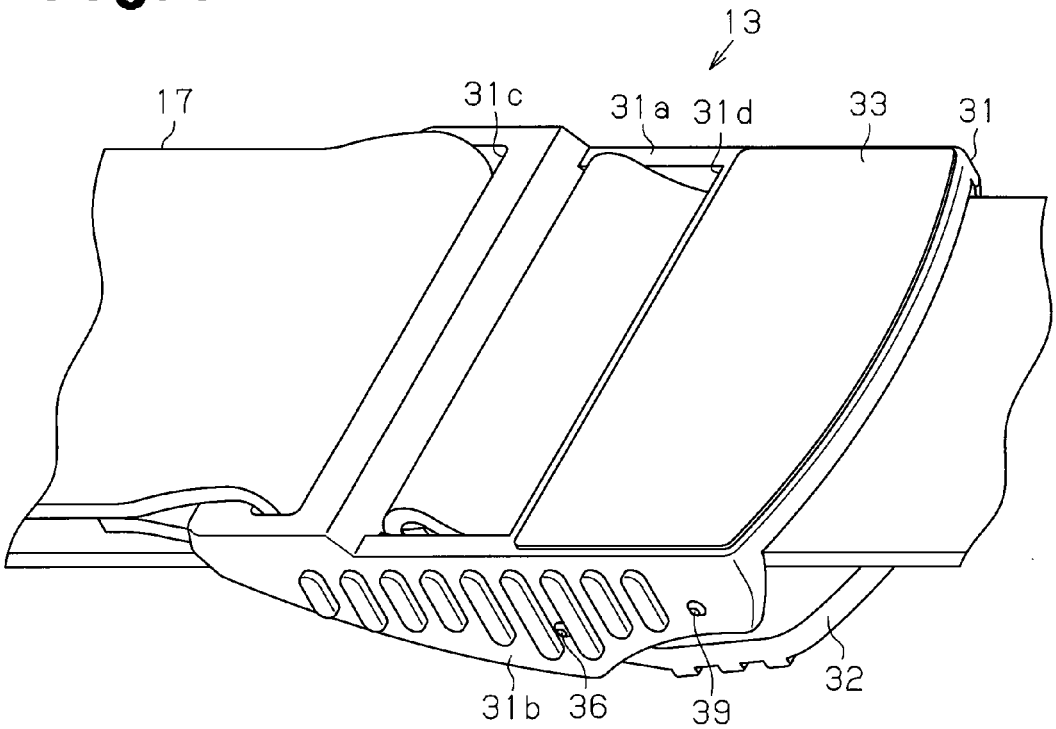
FIG. 4 is an enlarged perspective view showing the vicinity of the adjuster of the guitar strap as viewed from rear.
Figure 6:
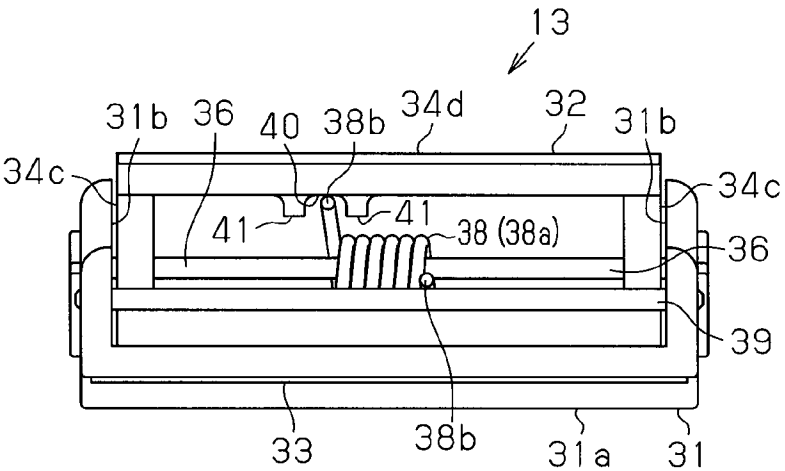
FIG. 6 is an end view showing the internal configuration of the adjuster.
Figure 5:
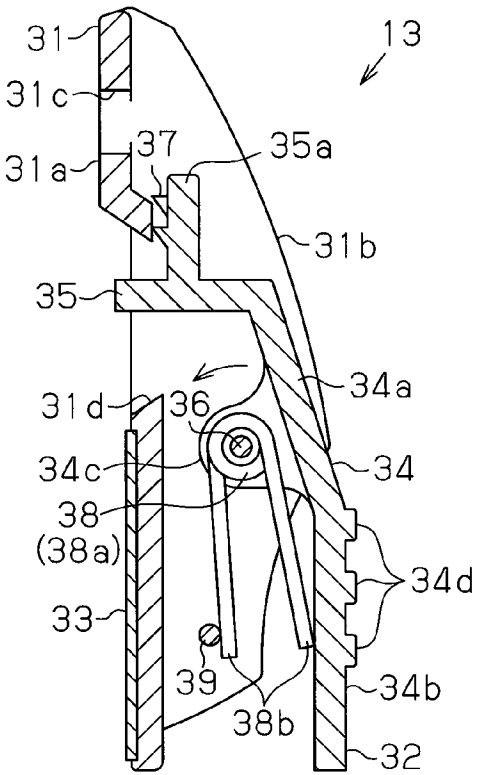
FIG. 5 is a longitudinal cross-sectional view showing the internal configuration of the adjuster.

As illustrated in FIGS. 2 to 4, the second belt section 17 is passed through the interior of the adjuster 13 and the slit 18*b* of the joint member 18, and is thus supported in a slidable manner. One end of the second belt section 17 is passed through the elongated hole 31*c* of the base 31 and sewn to a different portion of the second belt section 17. The connector 12 attached to the second end 2*b* of the body 2 is sewn to the other end of the second belt section 17. In this manner, the second belt section 17 is assembled with the adjuster 13 and the joint member 18 in a slidable manner with one end of the second belt section 17 connected to the adjuster 13. The second belt section 17 is formed in a looped shape between the adjuster 13 and the joint member 18, or in such a manner that a portion of the second belt section 17 is overlapped with another portion of the second belt section 17.

Figure 7B:
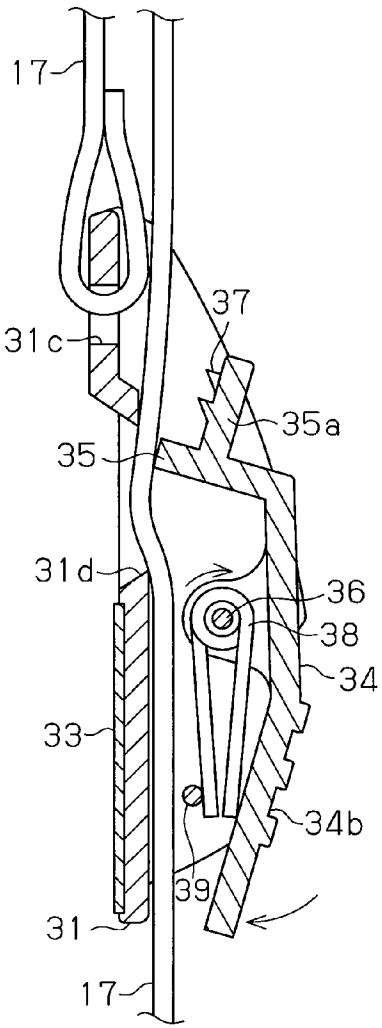
FIG. 7B is a longitudinal cross-sectional view showing the strap belt in a state released from the adjuster.
Figure 7A:
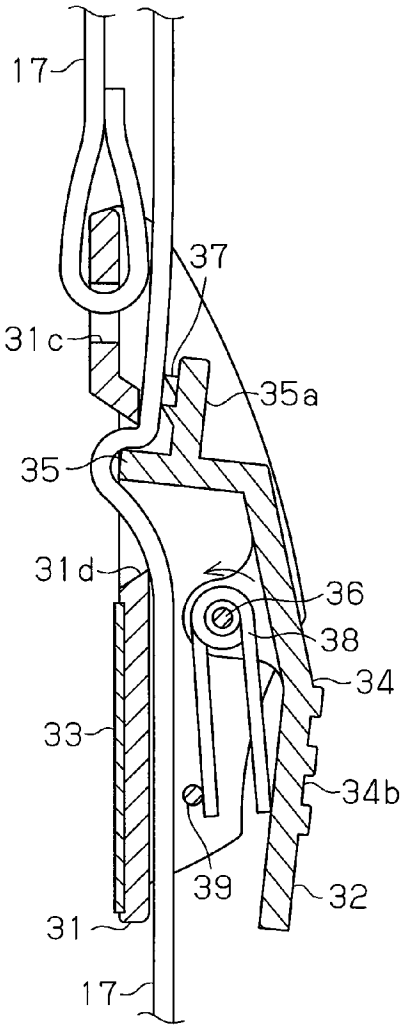
FIG. 7A is a longitudinal cross-sectional view showing a strap belt in a state held by the adjuster.

When the lever 32 is not manipulated, the second belt section 17 is clamped between the bottom wall 31*a* of the base 31 and the stopper portion 35 of the lever 32 by the urging force of the torsion spring 38, as illustrated in FIG. 7A. In this state, the stopper portion 35 of the lever 32 presses the second belt section 17 against the bottom wall 31*a* of the base 31. Also in this state, the multiple projections 37, which project from the projected portion 35*a* of the lever 32, stick into the second belt section 17. This supports the second belt section 17 in a non-slidable manner with respect to the adjuster 13.

As illustrated in FIG. 7B, by depressing the manipulating portion 34*b* of the lever 32, the lever 32 is pivoted about the shaft 36 in a second direction (the direction indicated by the arrow in FIG. 7B) against the urging force of the torsion spring 38. This separates the stopper portion 35 of the lever 32 from the bottom wall 31*a* of the base 31 and thus disengages the projections 37 of the lever 32 from the second belt section 17. In this manner, the second belt section 17 is released from a state clamped by the base 31 and the lever 32. This permits the second belt section 17 to slide with respect to the adjuster 13. The term "second direction" herein refers to the direction opposite to the first direction, which represents the direction in which the stopper portion 35 of the lever 32 is spaced from the bottom wall 31*a* of the base 31.

In a manner similar to the first belt section 16, the second belt section 17 can be extended to a length substantially equal to the full length of the second belt section 17 or shortened to a length that is substantially half the length of the second belt section 17. The second belt section 17 is shorter than the first belt section 16. Specifically, the second belt section 17 is set to a length greater or equal to ¼ and smaller than ½ of the length of the first belt section 16. Accordingly, the length of the second belt section 17 adjustable by the adjuster 13 is smaller than the length of the first belt section 16 adjustable by the adjuster 20, and, specifically, greater than or equal to ¼ and smaller than ½ of the length of the first belt section 16 adjustable by the adjuster 20.

A method for adjusting the length of the strap belt 11 using the strap 10 will hereafter be explained in detail with reference to FIGS. 1, 7A, and 7B.

Before hanging the guitar 1 down from the shoulders, the player first adjusts the length of the first belt section 16 using the adjuster 20. At this stage, by adjusting the length of the first belt section 16, the length of the strap belt 11 as a whole is roughly adjusted. After adjusting the length of the first belt section 16, the player hangs the guitar 1 down from the shoulders to see whether the length of the strap belt 11 is appropriate. Then, with the guitar 1 hung down from the shoulders, the player adjusts the length of the second belt section 17 using the adjuster 13. Specifically, the player fine adjusts the length of the strap belt 11 by adjusting the length of the second belt section 17 by manipulating the adjuster 13 until the guitar 1 is located at the most comfortable position for the player to play.

In such adjustment, the player manually depresses the manipulating portion 34*b* of the lever 32 as illustrated in FIG. 7B. This pivots the lever 32 about the shaft 36 in the second direction (the direction indicated by the arrow in FIG. 7B), separating the stopper portion 35 of the lever 32 from the bottom wall 31*a* of the base 31. The second belt section 17 is thus released from the state clamped between the base 31 and the lever 32. As a result, the second belt section 17 is permitted to slide with respect to the adjuster 13. In this manner, the player adjusts the length of the second belt section 17 while holding the manipulating portion 34*b* of the lever 32 in a manually depressed state, thus adjusting the length of the strap belt 11. When the manipulating portion 34*b* of the lever 32 is released, the urging force of the torsion spring 38 acts to pivot the lever 32 about the shaft 36 in the first direction (the direction indicated by the arrow in FIG. 7A). This causes the stopper portion 35 of the lever 32 to press the second belt section 17 against the bottom wall 31*a* of the base 31. The second belt section 17 is thus clamped between the base 31 and the lever 32 and the multiple projections 37 of the lever 32 stick into the second belt section 17. As a result, the second belt section 17 is maintained in a non-slidable manner with respect to the adjuster 13. In this manner, the player fixes the length of the second belt section 17 and thus the length of the strap belt 11 as a whole.

The present embodiment has the following advantages.

(1) The adjuster 13 has the base 31, the lever 32, and the torsion spring 38. The lever 32 is manipulated to adjust the length of the second belt section 17. The torsion spring 38 urges the lever 32 to pivot in the first direction. In this structure, by manipulating and pivoting the lever 32 in the second direction, the second belt section 17 is released from a state clamped between the base 31 and the lever 32. In this manner, by adjusting the length of the second belt section 17, the length of the strap belt 11 as a whole is adjusted. The lever 32 is not manipulated after the length of the second belt section 17 is adjusted. The urging force of the torsion spring 38 thus acts to clamp the second belt section 17 between the base 31 and the lever 32. In this manner, the length of the second belt section 17 is fixed, and so is the length of the strap belt 11 as a whole. This continuous adjustment is carried out easily by manipulating the lever 32. As a result, the player is allowed to adjust the length of the strap belt 11 by adjusting the length of the second belt section 17 with the guitar 1 hung down from the shoulders.

(2) The projected portion 35*a* of the lever 32 has the multiple projections 37, or the slip preventing means, which are located at the surface of the projected portion 35*a* facing the bottom wall 31*a* of the base 31. In this structure, the second belt section 17 is clamped between the base 31 and the lever 32 due to the urging force of the torsion spring 38. Further, since the projections 37 stick into the second belt section 17, the second belt section 17 is held in a non-slidable state with respect to the adjuster 13. Accordingly, even if the second belt section 17 is pulled downward by the weight of the guitar 1, the length of the second belt section 17 is further reliably fixed to the adjusted length. As a result, the length of the strap belt 11 is further reliably fixed.

(3) The adjuster 13 is arranged in the vicinity of the second end 2*b* of the body 2, which is opposed to the head 3 of the guitar 1. This arrangement allows the player to manipulate the lever 32 of the adjuster 13 by the dominant hand. The adjuster 13 is thus manipulated easily, and the player is allowed to easily adjust the length of the second belt section 17 with the guitar 1 hung down from the shoulders. As a result, the length of the strap belt 11 as a whole is adjusted easily.

(4) If the adjuster 13 is located in the vicinity of the body 2 of the guitar 1, the adjuster 13 may contact the body 2 of the guitar 1 when the player is in motion. This may damage the surface of the body 2. However, in the present embodiment, the adjuster 13 includes the impact absorbing member 33 that absorbs an impact caused by contact between the adjuster 13 and the guitar 1. Since the impact absorbing member 33 absorbs the impact caused by contact between the adjuster 13 and the guitar 1 when such contact occurs, the surface of the body 2 is prevented from being damaged.

(5) The engagement recess 40 is formed in the inner surface of the lever 32. In this structure, the engagement recess 40 causes engagement between the corresponding arm portion 38*b* of the torsion spring 38 and the lever 32. The urging force of the torsion spring 38 is thus reliably applied to the base 31 and the lever 32. Accordingly, the second belt section 17 is clamped between the base 31 and the lever 32 through increased urging force. The length of the second belt section 17 is thus further reliably fixed to the adjusted value. As a result, the length of the strap belt 11 as a whole is further reliably fixed.

(6) The manipulating portion 34*b*, which is manipulated to move the lever 32, is formed at one end of the lever 32. By depressing the manipulating portion 34*b*, the lever 32 is pivoted in the second direction and the second belt section 17 is released from a state claimed by the base 31 and the lever 32. In other words, simply by depressing the lever 32, the length of the second belt section 17 is adjusted so that the length of the strap belt 11 as a whole is adjusted. This further facilitates manipulation of the adjuster 13.

(7) The strap belt 11 has the two independent belts, or the first and second belt sections 16, 17. The adjuster 13 is used to change the length of the second belt section 17. In this structure, by using the adjuster 13, only the second belt section 17, which is a component of the strap belt 11, is adjusted. This permits adjustment of the length of the corresponding portion of the strap belt 11. As a result, by adjusting the length of the second belt section 17 using the adjuster 13, the length of the strap belt 11 as a whole is fine adjusted.

(8) Separately from the adjuster 13, the adjuster 20, or the first adjuster, is secured to the first belt section 16. This configuration allows adjustment of the length of the first belt section 16 using the adjuster 20 and adjustment of the length of the second belt section 17 using the adjuster 13, or the second adjuster. As a result, the length of the first belt section 16, which is adjustable by the adjuster 20, and the length of the second belt section 17, which is adjustable by the adjuster 13, can be set to respective desired lengths as needed.

(9) The length of the second belt section 17 adjustable by the adjuster 13 is smaller than the length of the first belt section 16, which is adjustable by the adjuster 20. Accordingly, the adjuster 20 is used to roughly adjust the length of the strap belt 11, while the adjuster 13 is employed to fine adjust the length of the strap belt 11. In other words, the adjuster 20 and the adjuster 13 are selectively operated to adjust the length of the strap belt 11, depending on the purposes.

(10) Using the method for adjusting the length of the strap belt 11 of the present embodiment, the player adjusts the length of the first belt section 16 using the adjuster 20 before hanging the guitar 1 down from the shoulders. In this adjustment, the player roughly adjusts the length of the strap belt 11. Then, with the guitar 1 hung down from the shoulders, the player adjusts the length of the second belt section 17 using the adjuster 13. At this stage, the player fine adjusts the length of the strap belt 11 by adjusting the length of the second belt section 17 until the guitar 1 is located at the most comfortable position for the player to play. Through such continuous adjustment, the length of the strap belt 11 is adjusted efficiently and appropriately.

The above illustrated embodiment may be modified as follows.

In the above illustrated embodiment, the first belt section 16 may be omitted from the strap belt 11. In other words, the guitar strap 10 may be formed only by the second belt section 17 having the adjuster 13.

In the above illustrated embodiment, the adjuster 13 may be omitted from the second belt section 17 and the adjuster 20 of the first belt section 16 may be replaced by the adjuster 13. Alternatively, the first and second belt sections 16, 17 may both include an adjuster 13.

In the above illustrated embodiment, the projections 37 may be omitted from the projected portions 35*a* of the lever 32. Alternatively, the projections 37 may be formed on the inner surface of the bottom wall 31*a* of the base 31 instead of the lever 32. In other words, as long as the projections 37 are formed on a surface holding the second belt section 17 of either one of the base 31 and the lever 32, the projections 37 may be arranged at any suitable location. Further, the projections 37 may be arranged on both the projected portion 35*a* of the lever 32 and the inner surface of the bottom wall 31*a* of the base 31.

In the above illustrated embodiment, the slip preventing means may be, other than the tapered projections, columnar projections, projections extending in the direction of the width of the lever 32, or a rough surface with great surface roughness.

In the above illustrated embodiment, the impact absorbing member 33 may be omitted from the base 31. Also, the impact absorbing member 33 is not restricted to the rubber plate but may be formed of elastic material such as sponge or felt.

In the above illustrated embodiment, the torsion spring 38 may be replaced by a compression coil spring. In this case, the compression coil spring is fixed to the inner surface of the lever 32 or the base 31 in a compressed state.

In the above illustrated embodiment, the serrations 34*d* may be omitted from the manipulating portion 34*b* of the lever 32. Alternatively, the serrations 34*d* may be replaced by a plurality of projections, which project from the manipulating portion 34*b*. Also, instead of providing the serrations 34*d* or the projections, the surface roughness of the manipulating portion 34*b* may be increased compared to the other portions.

Figure 8B:
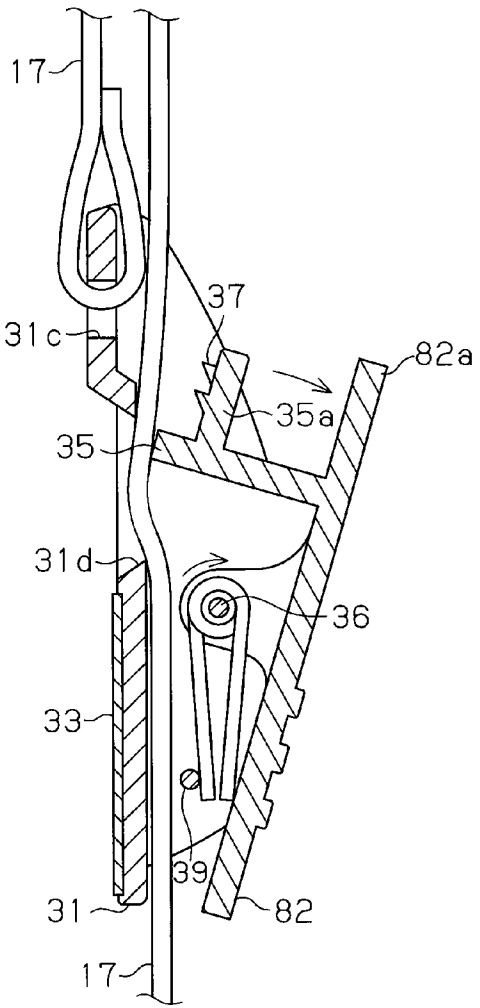
FIG. 8B is a longitudinal cross-sectional view showing the strap belt in a state released from the adjuster of the modification.
Figure 8A:
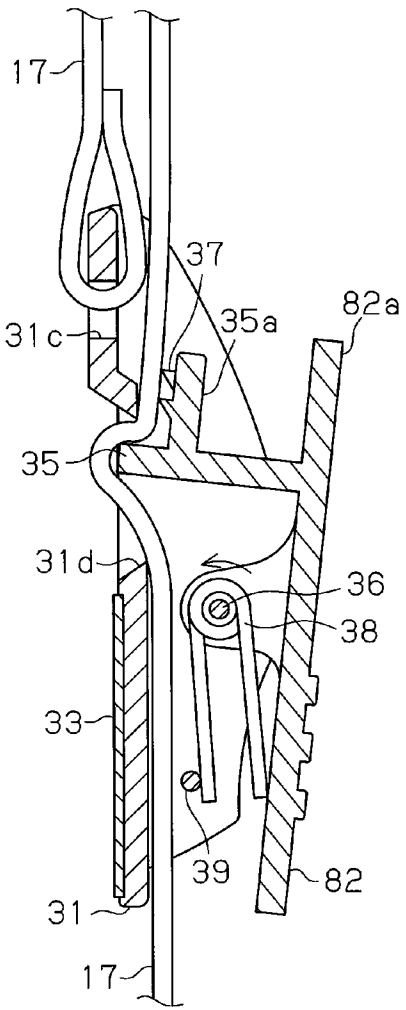
FIG. 8A is a longitudinal cross-sectional view showing a strap belt in a state held by an adjuster of a modification.

Alternatively, with reference to FIGS. 8A and 8B, a manipulating portion 82*a* may be formed at an end of a lever 82 that is opposed to the torsion spring 38. In this case, the manipulating portion 82*a* of the lever 82 is raised in the direction indicated by the arrow in FIG. 8B. This releases the second belt section 17 from a state clamped by the base 31 and the lever 32.

In the above illustrated embodiment, the length of the second belt section 17 adjustable using the adjuster 13 may be greater than or equal to the length of the first belt section 16, which is adjustable by the adjuster 20.

Other than the guitar strap, the present invention may be embodied as a strap for a musical instrument that can be played while being hung down from the shoulders of a player, such as a bass guitar or a keyboard.

The invention claimed is:

1. A strap for a musical instrument including a strap belt and an adjuster that adjusts the length of the strap belt, wherein the adjuster includes a base, a lever pivotally secured to the base and manipulated to adjust the length of the strap belt, and urging means arranged between the base and the lever and urging the lever to pivot in a first direction, wherein the strap belt is clamped by the base and the lever due to an urging force of the urging means and released from a state clamped by the base and the lever by pivoting the lever in a second direction different from the first direction against the urging force of the urging means, and wherein a manipulating portion manipulated to operate the lever is located at one end of the lever, the lever being pivoted in the second direction by depressing the manipulating portion.

2. The strap for the musical instrument according to claim 1, wherein the adjuster has slip preventing means that prevents slipping with respect to the strap belt.

3. The strap for the musical instrument according to claim 2, wherein the slip preventing means is formed by a plurality of projections, the projections being formed on a surface clamping the strap belt of at least one of the base and the lever.

4. The strap for the musical instrument according to claim 1, wherein a body of the musical instrument has a pair of ends to which both ends of the strap belt are attached, and wherein the adjuster is arranged in the vicinity of either one of the ends of the body.

5. The strap for the musical instrument according to claim 4, wherein the adjuster includes an impact absorbing member that absorbs an impact caused by contact between the adjuster and the body.

6. The strap for the musical instrument according to claim 1, wherein the urging means is a torsion spring having a pair of arm portions, and wherein an engagement recess is formed in at least one of the base and the lever to be engaged with the arm portions of the torsion spring.

7. The strap for the musical instrument according to claim 4, wherein the strap belt is configured by a first belt section attached to a first end of the body and a second belt section attached to a second end of the body, and wherein the adjuster is secured to the first or second belt section and adjusts the length of the belt section to which the adjuster is secured.

8. The strap for the musical instrument according to claim 7, wherein the adjuster is one of a first adjuster and a second adjuster, the first adjuster being arranged in the first belt section to adjust the length of the first belt section, and the second adjuster being arranged in the second belt section to adjust the length of the second belt section.

9. The strap for the musical instrument according to claim 8, wherein the length of the strap belt adjustable by the first adjuster is unequal to the length of the strap belt adjustable by the second adjuster.

10. A method for adjusting the length of a strap belt using the strap for the musical instrument according to claim 8, the method comprising:

adjusting the length of the strap belt by adjusting the length of the first belt section using the first adjuster before the musical instrument is hung down from the shoulders of a player; and fine adjusting the length of the strap belt by adjusting the length of the second belt section using the second adjuster with the musical instrument hanging down from the shoulders of the player after the length of the first belt section has been adjusted.

* * * * *